US006147671A

United States Patent [19]

Agarwal

[11] Patent Number: 6,147,671

[45] Date of Patent: Nov. 14, 2000

[54] TEMPORALLY DISSOLVED DITHERING

[75] Inventor: Rohit Agarwal, Hillsboro, Oreg.

[73] Assignee: Intel Corporation, Santa Clara, Calif.

[21] Appl. No.: 08/305,262

[22] Filed: Sep. 13, 1994

[51] Int. Cl.[7] ..... G09G 5/10

[52] U.S. Cl. ..... 345/149; 358/457; 348/574

[58] Field of Search ..... 345/199, 149, 345/155, 431, 432, 147, 150; 358/456, 457; 348/472, 574

[56] References Cited

U.S. PATENT DOCUMENTS

| | | | |
|---|---|---|---|
| 4,706,077 | 11/1987 | Roberts et al. | 345/149 |
| 4,743,959 | 5/1988 | Frederiksen . | |
| 4,775,858 | 10/1988 | Stapleton et al. . | |
| 4,857,992 | 8/1989 | Richards . | |
| 4,991,122 | 2/1991 | Sanders . | |
| 5,068,644 | 11/1991 | Batson et al. . | |
| 5,107,349 | 4/1992 | Ng et al. | 358/457 |
| 5,124,688 | 6/1992 | Rumball | 345/199 X |
| 5,138,303 | 8/1992 | Rupel | 345/155 X |
| 5,142,273 | 8/1992 | Wobermin . | |
| 5,204,664 | 4/1993 | Hamakawa . | |
| 5,218,431 | 6/1993 | Gleicher et al. . | |
| 5,218,432 | 6/1993 | Wakeland . | |
| 5,220,410 | 6/1993 | Wakeland et al. . | |
| 5,233,684 | 8/1993 | Ulichney . | |
| 5,258,826 | 11/1993 | Wakeland et al. . | |
| 5,329,292 | 7/1994 | Nishioka et al. . | |
| 5,341,442 | 8/1994 | Barrett . | |
| 5,381,180 | 1/1995 | Keith | 345/199 X |
| 5,384,582 | 1/1995 | Keith et al. | 345/199 |
| 5,406,310 | 4/1995 | Aschenbrenner et al. . | |
| 5,416,614 | 5/1995 | Crawford . | |
| 5,428,465 | 6/1995 | Kanamori et al. . | |
| 5,428,720 | 6/1995 | Adams, Jr. . | |
| 5,430,465 | 7/1995 | Sabella et al. . | |
| 5,450,098 | 9/1995 | Oz | 345/199 |

OTHER PUBLICATIONS

IBM Technical Disclosure Bulletin, vol.37, No. 03, Mar. 1994 New York, US, pp. 95–96, XP 000441392 'Direct–to–Palette Dithering.'

IBM Technical Disclosure Bulletin, vol. 33, No. 5, Oct. 1990 New York, US, pp. 200–205, XP 000107434 'Default RGB Color Palette with Simple Conversion from YUV.'

IEEE Transactions on Consumer Electronics, vol. 37, Issue 3, Aug. 1991, pp. 182–189, "Single–Chip Video Processing System," by Hans–Jürgen Désor.

*Primary Examiner*—Kent Chang

*Attorney, Agent, or Firm*—Duane, Morris & Heckscher LLP

[57] ABSTRACT

A set different dither matrices is employed in a repetitive manner to accomplish elimination of contouring while at the same time not adding typical "dither graininess" to a digital video image. The matrices are specially chosen to result in a time-averaged zero dithering bias when applied frame-by-frame in a long sequence of frames.

20 Claims, 5 Drawing Sheets

TEMPORALLY DISSOLVED DITHERING

BACKGROUND OF THE INVENTION

This invention relates to digital video image processing, and more particularly to dithering in conversion of image data from a YUV-like format to an RGB format.

In color conversion systems, such as those used to convert from YUV9 to RGB8, the source data format contains more precision than the destination format. An example of this concept is depicted in FIG. 1, which shows an entire color conversion process going from YUV24 to YUV9 to CLUT8 (i.e., RGB8) and then to RGB24 for display. In particular, therein is depicted the mapping from YUV9 to RGB8, wherein large groups of YUV9 colors all become particular RGB8 colors. These 256 RGB8 colors then are converted via the CLUT (Color Look Up Table) into the 256 particular RGB 24 values picked by the designer of the CLUT a priori.

In the conversion from YUV24 to YUV9, an undesirable reproduction artifact can be introduced into the image due to the fact that single U and V values are used, for example, for 4×4 groups of 16 Y values. In common practice, these artifacts are eliminated or at least reduced either by use of various interpo-lation techniques on the U and V values within the 4×4 groups.

Similarly, in the conversion from YUV9 to RGB8, another undesirable reproduction artifact known as "contouring" can occur. For example, when large areas of the image have only slight variations in color, those areas will be represented by only one of the 256 RGB8 colors, and the reproduced image can have distinct noticeable contours outlining those areas. Contouring is associated with the ability of the human visual system to perceive small changes in image intensity in areas of an image that have low spatial variation in image intensity. If an insufficient number of bits is used to represent intensities in such areas, the human visual system perceives the changes in intensity as happening in steps and not in a continuous manner. It is well known that one way to eliminate these contours is to use dithering of "near neighborhood" RGB8 colors. This is typically done using a fixed dithering matrix at amplitudes less than the step size of the Y intensity quantization being used on the Y values of each 4×4 block of pixels in a video frame.

Unfortunately, using a fixed dithering matrix can result in another undesirable artifact of "graininess" in the reproduced image. It is therefore desirable to have a method for eliminating this perceived graininess.

SUMMARY OF THE INVENTION

In order to reproduce a more natural appearing image, the dithering matrix is changed frame by frame. In this manner the same amount of dithering is accomplished with each frame, but different dithering patterns are used sequentially in time so that the tendency for perceivable graininess to occur is greatly reduced. By picking the value used for the dithering matrices artfully, the system designer can cause the time-averaged dither intensity at any and all pixel locations on a screen to be zero. This has the effect of "dissolving" any graininess artifacts observed—hence the name Temporally Dissolved Dithering (TDD).

DETAILED DESCRIPTION

Figure 5:
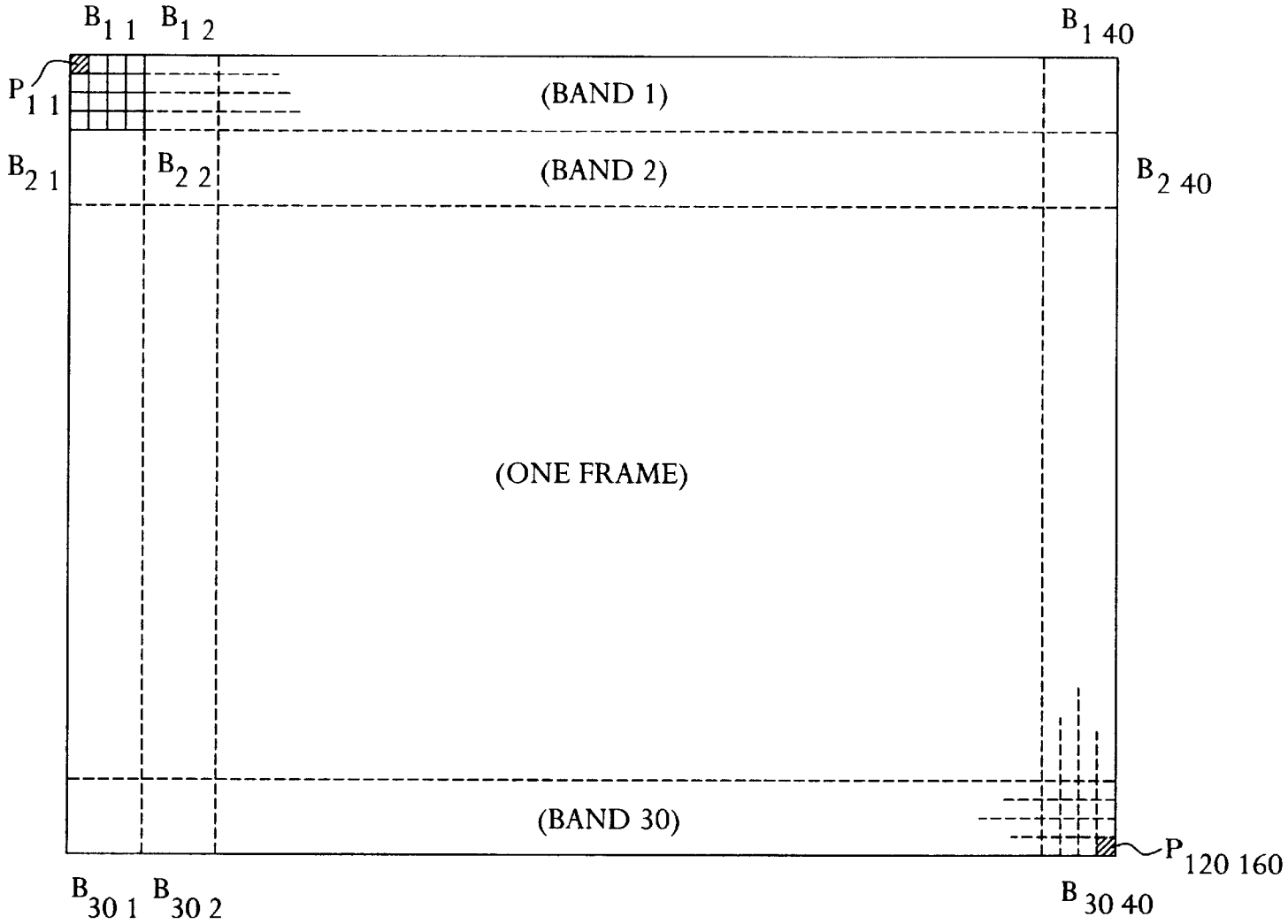
FIG. 5 depicts a typical digital video frame.
Figure 6:
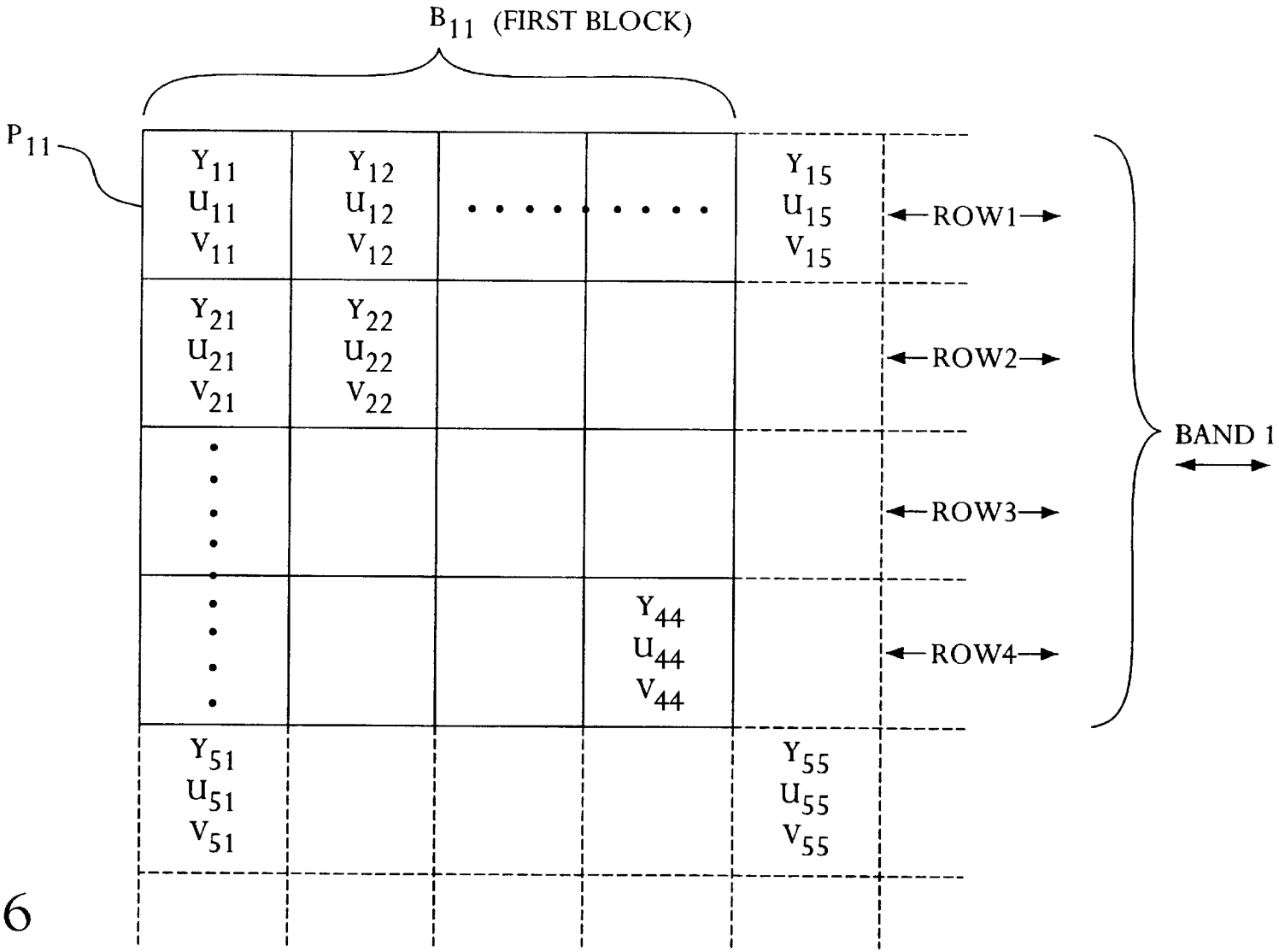
FIG. 6 depicts a 4×4 block in a digital video frame such as shown in FIG. 5.

In a preferred embodiment of Applicant's invention, dithering is applied to 4×4 blocks of pixels sequentially throughout a frame of digital video YUV9 data. FIG. 5 shows such a frame divided into 30 bands and 40 columns of such 4×4 blocks of pixels. The first block of such a frame is depicted in FIG. 6. In the original YUV9 format, there is a separate 8 bit Y value and a single (and same) 8 bit U value and a single (and same) 8 bit V value for each pixel $P_{11}$–$P_{44}$. In other words, the Y values (which represent the intensity, i.e. "brightness") can be different for all 16 pixels in the block, but the U values are the same for all 16 pixels in the block, and the V values are the same for all 16 pixels in the block (wherein U and V taken together represent the hue of the pixels in the block). So any given block in the frame can have one of $2^{16}$ different hues and each pixel in a block can have $2^8$ different intensity levels, thus allowing for a total of $2^{24}$ different possible "colors" for each pixel in a block.

In order to convert from all these possible colors down to a palette of $2^8$ colors in an 8 bit color look up table ("CLUT8"), it is necessary to choose some combination for reduced quantization of the original Y, U, and V values. One typical choice is to pick $2^5$ possible Y values (i.e. $2^5$ different possible intensities) and $2^3$ possible combinations of U and V values (i.e. $2^3$=8 different hues). This means that the quantization of the Y values has been changed from unit steps (i.e. 0–255 in steps of 1) to 32 steps of eight (i.e. 0–255 in steps of 8), and the hue quantization has been changed from $2^{16}$, in steps of 1, to a total of 8 increments (i.e. 8 different hues) picked by the system designer.

In practice, the reduced quantization of Y values can (and often does) result in the phenomenon called "contouring" in the resulting color image. This contouring artifact amounts to plateaus of a given color appearing on the image with distinct outlines for the boundaries of the plateaus. This give an unrealistic "cartoon" effect to the image that is very distracting to a human observer.

One known approach for removing this contouring effect caused by the reduced quantization of the Y values is to "dither" these Y values block by block with a 4×4 dithering matrix that "modulates" the Y values pixel by pixel so that the contours disappear. So, for example, for Y values quantized in steps of 8, in accordance with known practice, one might use the following dither pattern:

$$D = \begin{matrix} +3, & -1, & -3, & +1 \\ -1, & -3, & +1, & +3 \\ -3, & +1, & +3, & -1 \\ +1, & +3, & -1, & -3 \end{matrix}$$

As is known in the art, this dither pattern would be used for each 4×4 block of each frame, frame after frame. This produces another artifact known as "graininess" in the resulting image, but it does eliminate the contouring problem.

Applicant has discovered a technique for eliminating both graininess and contouring! Instead of using the same dithering matrix for each successive frame, different dithering matrices are used frame by frame sequentially in time in a pattern that averages out to zero dithering intensity averaged over time for each pixel location (while actually introducing some dithering for each Y value for each pixel location in each successive frame). This requires the use of multiple dither matrices specially chosen and applied over time to achieve the above-described zeroing (or "dissolving") effect. To wit, for the dither matrix D given above, one could accomplish the desired effect by using three additional dither matrices as follows:

$$D1 = \begin{matrix} +1, & +3, & -1, & -3 \\ +3, & -1, & -3, & +1 \\ -1, & -3, & +1, & +3 \\ -3, & +1, & +3, & -1 \end{matrix}$$

$$D1 = \begin{matrix} -3, & +1, & +3, & -1 \\ +1, & +3, & -1, & -3 \\ +3, & -1, & -3, & +1 \\ -1, & -3, & +1, & +3 \end{matrix}$$

and $$D3 = \begin{matrix} -1, & -3, & +1, & +3 \\ -3, & +1, & +3, & -1 \\ +1, & +3, & -1, & -3 \\ +3, & -1, & -3, & +1 \end{matrix}$$

The reader will note by careful perusal of these four matrices that the average dithering value at any particular pixel location for these four matrices taken together is zero! It is also important to note that for these four numbers (+3, +1, −1, −3), there are (4!=24) different possible arrangements (i.e. permutations) for choosing the first row of the first of four matrices picked, (3!=6) permutations for the first row of the second of four matrices picked, (2!=2) permutations for the first row of the third of four matrices picked, and only one way to pick the first row of the fourth of four matrices picked. Thus the system designer has significant flexibility in picking suitable dithering matrices to implement the invention.

The dither matrices D, D1, D2, and D3 are then applied to each block of sequential frames of data in a repeating pattern frame by frame such as: (D, D1, D2, D3, D2, D1, D, $D_1$, $D_2$, - - - ) so that over time (i.e., as the frames are displayed sequentially in time) the time-averaged dither value at any pixel location is zero. This results in elimination of the graininess artifact of the prior art, while at the same time removing the undesirable contour lines from the displayed image.

Figure 1:
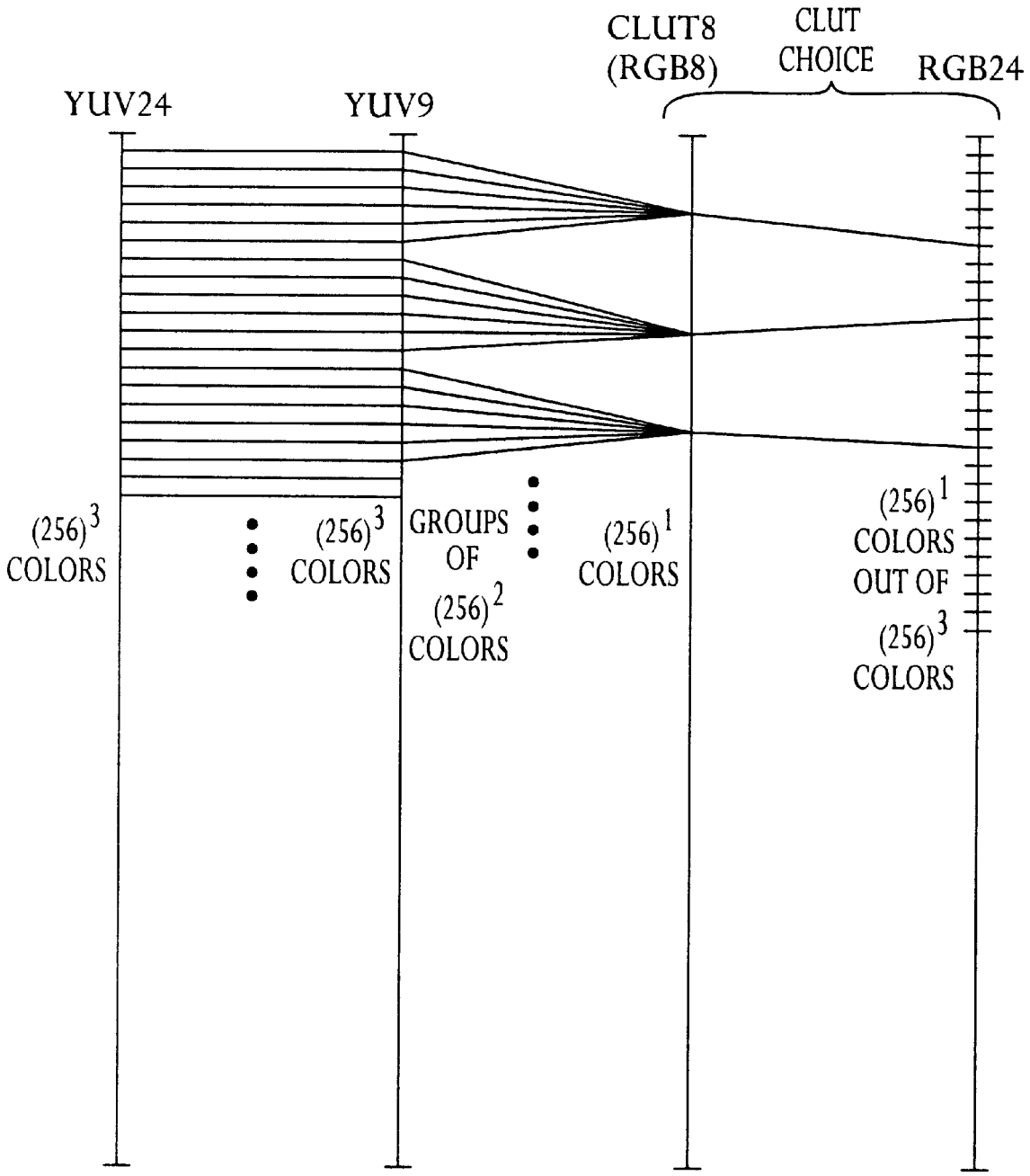
FIG. 1 depicts one example of a digital color conversion process.
Figure 2:
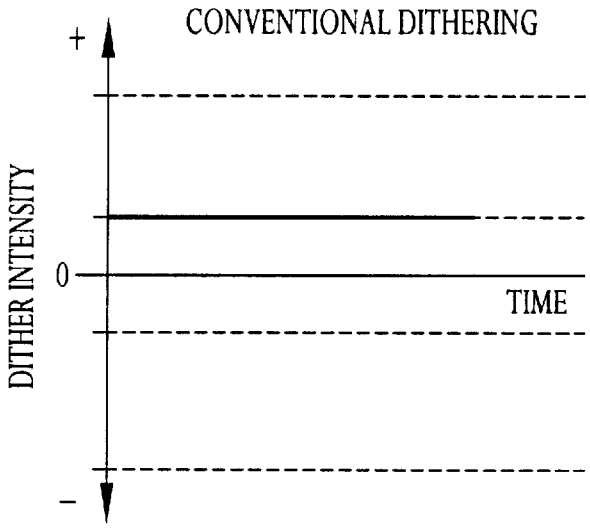
FIG. 2 shows a conventional dithering intensity vs. time graph.
Figure 3:
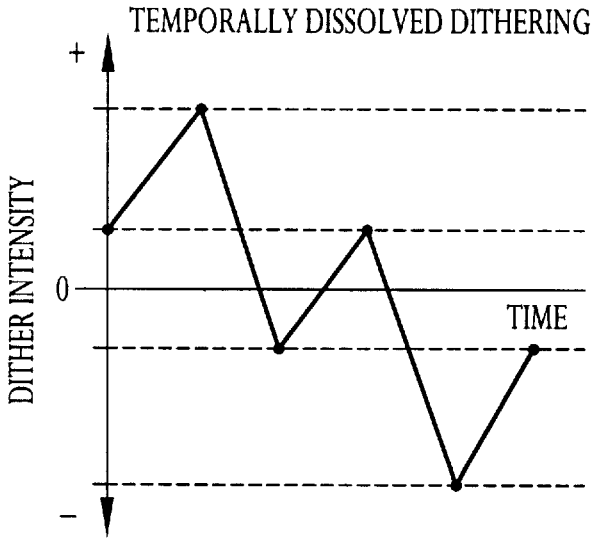
FIG. 3 shows the time averaging-to-zero effect of Temporally Dissolved Dithering.

The effect of use of the invention is demonstrated in FIGS. 2 and 3, wherein it is shown that conventional dithering results in an overall non-zero dithering bias, whereas TDD averages out to a zero dithering bias over time.

Figure 4:
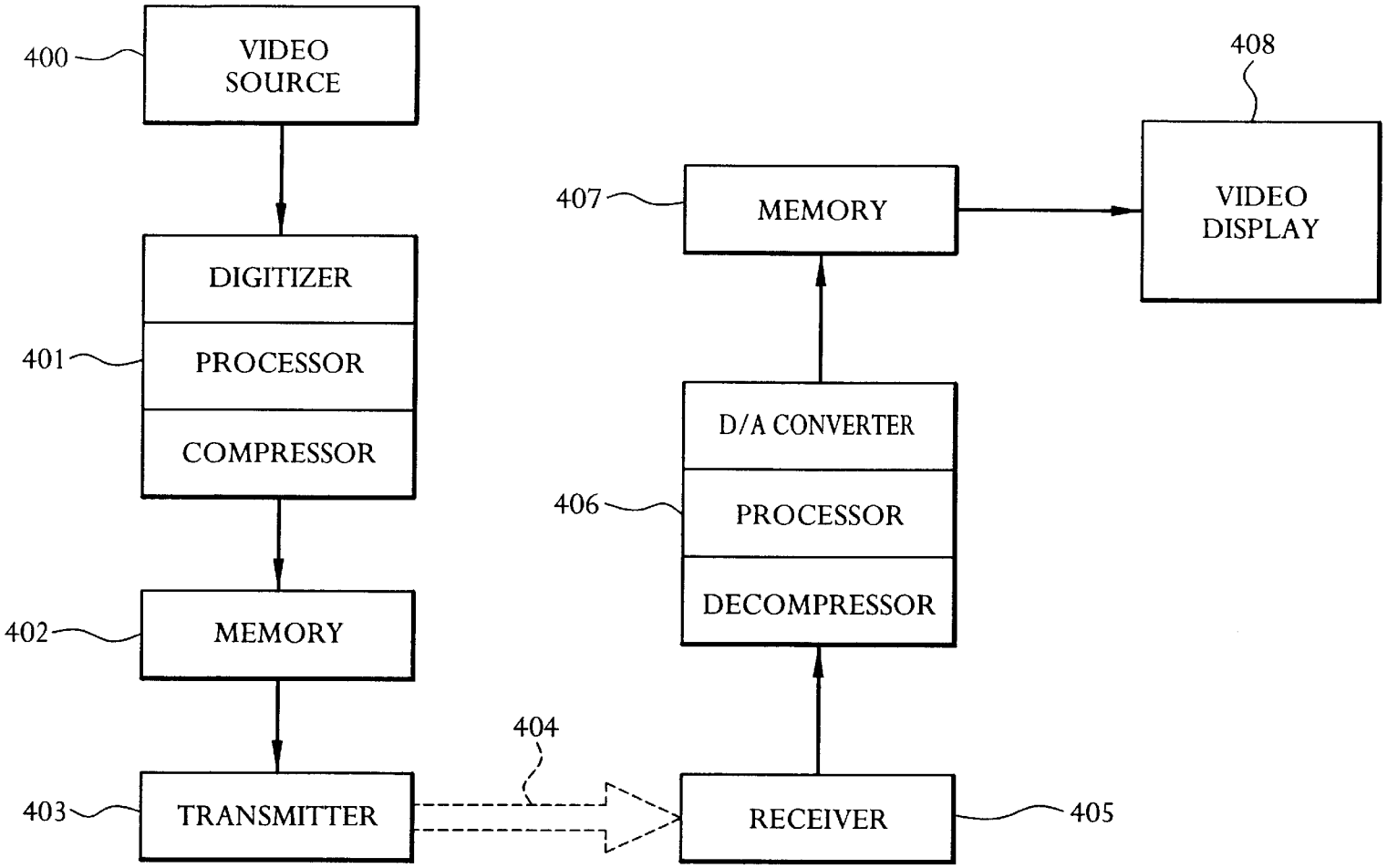
FIG. 4 shows a typical digital video transmission system suitable for employing Temporally Dissolved Dithering.

A typical digital video transmission system suitable for implementing the instant invention is shown in FIG. 4. The components shown are all known well to those skilled in the art, and can be implemented with standard equipment available from a variety of suppliers. Analog video source 400 transmits an analog video signal to a digitizer/processor/compressor 401 wherein the method of the instant invention is used as the digitized data is being processed. It is a "simple matter of programming" for one skilled in the art to write a program (suitable for the particular processor used) that accomplishes the method of the instant invention using the following example process:

GIVEN: a dither matrix D having N distinct dither levels.

CONSTRUCTION: Construct N−1 permutations of the given dither matrix D by successively cycling through the N dither levels at each location in the matrix. Denote these dither patterns by D1, D2, - - - , D(N−1).

APPLICATION PROCEDURE: For a given video frame numbered K in the video sequence, IF (K div N) is even {apply dither pattern D (K modulo N)}

ELSE {apply dither pattern D (N−(K modulo N))}.

Once the desired implementation of TDD is accomplished, the data can be stored in memory 402 (optional) and later sent to transmitter 403 which sends the data along digital transmission path 404 to receiver 405 which in turn sends the data through decompressor/processor/digital-to-analog converter 406 and on to memory 407 (optional) for later viewing on video display 408. The implementation of the invention takes relatively little processing time (in addition to conventional dithering) but the resultant easily-recognizable image improvement is quite significant.

Although specific examples have been given above, Applicant's invention is not at all limited to these examples, but rather is defined by the appended claims and their fair equivalents.

What is claimed is:

1. In a digital video processing system, a method for dithering quantized color values having a given step size during a color conversion process, comprising the steps of:

(A) adding a set of dither values to first color values throughout a first frame of digital video values;

(B) adding a different set of dither values to second color values throughout a second frame of digital video values, said second frame being subsequent to said first frame in time sequence; and, (C) repeating steps (A) and (B) for subsequent frames in time order;

wherein the time-averaged value of said dither values at a given pixel location is zero.

2. The method of claim 1, wherein steps (A) and (B) are repeated sequentially for additional further different sets of dither values on additional frames of digital video values in time sequence.

3. The method of claim 1, wherein said dithering values used have amplitudes less than the step size of the color value quantization being used.

4. The method of claim 1, wherein said second frame is immediately subsequent to said first frame in time sequence.

5. The method of claim 1, wherein said sets of dither values comprise dither matrices.

6. The method of claim 5, wherein said dither matrices are applied to said frames in blocks of pixel locations throughout said frames.

7. The method of claim 6, wherein said blocks of pixels are square blocks.

8. The method of claim 7, wherein said square blocks are 4×4 blocks.

9. The method of claim 1, wherein said color conversion process comprises converting YUV9 color data to CLUT8 color data.

10. The method of claim 9, wherein said color values comprise the Y values of said YUV9 color data.

11. In a digital video processing system, apparatus for dithering quantized color values having a given step size during a color conversion process, comprising:

(A) means for adding a set of dither values to first color values throughout a first frame of digital video values;

(B) means for adding a different set of dither values to second color values throughout a second frame of digital video values, said second frame being subsequent to said first frame in time sequence; and, (C) means for repeating steps (A) and (B) for subsequent frames in time order;

wherein the time-averaged value of said dither values at a given pixel location is zero.

12. The apparatus of claim 1, wherein the apparatus (A) and (B) are used for applying sequentially additional further different sets of dither values on additional frames of digital video values in time sequence.

13. The apparatus of claim 1, wherein said dithering values used have amplitudes less than the step size of the color value quantization being used.

14. The apparatus of claim 1, wherein said second frame is immediately subsequent to said first frame in time sequence.

15. The apparatus of claim 1, wherein said sets of dither values comprise dither matrices.

16. The apparatus of claim 5, wherein said dither matrices are applied to said frames in blocks of pixel locations throughout said frames.

17. The apparatus of claim 6, wherein said blocks of pixels are square blocks.

18. The apparatus of claim 7, wherein said square blocks are 4×4 blocks.

19. The apparatus of claim 1, wherein said color conversion process comprises converting YUV9 color data to CLUT8 color data.

20. The apparatus of claim 9, wherein said color values comprise the Y values of said YUV9 color data.

* * * * *